US005727278A

United States Patent [19]

Per-Lee

[11] Patent Number: 5,727,278

[45] Date of Patent: Mar. 17, 1998

[54] CLEANSING DEVICE WITH HAND STRAP AND METHOD OF MAKING SAME

[76] Inventor: Myra S. Per-Lee, 16136 Avenida Venusto, No. 2, San Diego, Calif. 92128

[21] Appl. No.: 634,786

[22] Filed: Apr. 19, 1996

[51] Int. Cl.[6] ..... A47L 17/08; A47K 7/02

[52] U.S. Cl. ..... 15/229.11; 15/209.1; 15/223; 300/21

[58] Field of Search ..... 15/208, 209.1, 15/223, 229.11, 229.12, 229.14; 29/525.01; 300/21

[56] References Cited

U.S. PATENT DOCUMENTS

| | | | |
|---|---|---|---|
| D. 230,814 | 3/1974 | Everts | 15/229.11 X |
| 1,713,975 | 5/1929 | Mayer | 15/229.11 |
| 1,820,256 | 8/1931 | Stewart | 15/223 X |
| 1,897,778 | 2/1933 | Wallace . | |
| 1,963,529 | 6/1934 | Protz | 15/208 |
| 2,152,697 | 4/1939 | Kingman | 15/229.11 |
| 2,581,779 | 1/1952 | Abraham | 15/229.11 |
| 3,146,479 | 9/1964 | Stoker | 15/118 |
| 3,336,618 | 8/1967 | Day | 15/229.11 |
| 3,343,196 | 9/1967 | Barnyhouse . | |
| 3,345,668 | 10/1967 | Forrest . | |
| 4,199,835 | 4/1980 | Heyer et al. . | |
| 5,465,452 | 11/1995 | Girardot et al. | 15/209.1 X |
| 5,491,864 | 2/1996 | Tuthill et al. | 15/209.1 X |

FOREIGN PATENT DOCUMENTS

| | | | |
|---|---|---|---|
| 2287886 | 5/1976 | France | 15/209.1 |
| 420519 | 3/1967 | Switzerland | 15/229.11 |

*Primary Examiner*—Mark Spisich

*Attorney, Agent, or Firm*—Flanagan & Flanagan; John K. Flanagan; John R. Flanagan

[57] ABSTRACT

A cleansing device includes a body formed by at least one sheet of inelastic flexible netting-like material folded upon itself to provide a multiplicity of ruffles bunched together so as to define the body, an elongated flat and narrow strap comprised of interwoven strands of flexible material and provided in the form of a loop, and an elongated string inserted at least one time through the loop of the strap and wound about a circumferential portion of the body and drawn inwardly toward the center of the body to form a winding of the string having a substantially smaller circumference than that of the body which secures an inner end of the loop of the strap to the body at an interior of the body such that the inner end of the strap is substantially hidden from an exterior of the body and the strap extends from the body to an outer end spaced from the body to provide a looped handle for a user to insert one hand through and thereby place the body in the palm of the one hand of the user for holding by the fingers and thumb of the user.

30 Claims, 2 Drawing Sheets

CLEANSING DEVICE WITH HAND STRAP AND METHOD OF MAKING SAME

BACKGROUND OF THE INVENTION

1. Field of the Invention

The present invention generally relates to cleansing devices for cleaning, scouring, scrubbing and polishing objects and, more particularly, is concerned with a cleansing device having a flexible hand strap for encompassing a user's hand.

2. Description of the Prior Art

It is often desirable to use a brush or the like to clean the skin of an individual's body, to exfoliate dry skin from the body and/or to stimulate blood circulation through the body. It is likewise generally desirable to clean and polish rigid objects and surfaces such as those found in the kitchens and bathrooms of a home. A variety of cleansing devices have been developed over the years for cleaning, scouring and polishing metal objects such as kitchen utensils and the like. A common element in many of these devices is the use of abrasive material which is folded upon itself to provide a conglomeration of material for scouring objects or surfaces to be cleaned or polished.

Representative examples of these cleansing devices and other like devices are disclosed in U.S. Pat. No. 1,713,975 to Mayer, U.S. Pat. No. 1,897,778 to Wallace, U.S. Pat. No. 1,963,529 to Protz, U.S. Pat. No. 2,152,697 to Kingman, U.S. Pat. No. 2,581,779 to Abraham, U.S. Pat. No. 3,146,479 to Stoker, U.S. Pat. No. 3,336,618 to Day, U.S. Pat. No. 3,343,196 to Barnhouse, U.S. Pat. No. 3,345,668 to Forrest and U.S. Pat. No. 4,199,835 to Heyer et al. A problem exists, however, with these prior art devices in that none of them appear to have a suitable means for ergonomically securing the device to the hand of a user so that the device can easily be retained by the user while it undergoes vigorous action and which securing means as part of the cleansing device will not impede its use in a variety of applications such as on the skin of an individual's body and on objects and surfaces found in kitchens and bathrooms of homes.

Consequently, a need still exists for a cleansing device which overcomes the aforementioned problem in the prior art without introducing any new problems in place thereof.

SUMMARY OF THE INVENTION

The present invention provides a cleansing device which is designed to satisfy the aforementioned need. The cleansing device has a flexible hand strap attached to a body of flexible abrasive material and fittable around the hand of a user so as to ergonomically secure the device to the user's hand with the body of abrasive material positioned for gripping by the user's hand. The hand strap does not impede but instead facilitates use of the cleansing device in a variety of applications such as for use on the skin of an individual's body and for use on objects and surfaces found in kitchens and bathrooms of homes. The abrasive material of the body can be selected so as to best suit the specific application.

Accordingly, the present invention is directed to a cleansing device which comprises: (a) a body of flexible abrasive material; (b) an elongated flexible strap provided in the form of a loop; and (c) means for securing an inner end of the strap to substantially a central portion of the body such that the strap extends from the body to an outer end thereof spaced from the body to provide a looped handle for a user to insert one hand through and thereby place the body in the palm of the one hand of the user for holding by the fingers and thumb of the user.

The body is generally formed by at least one sheet of inelastic flexible netting-like abrasive material folded upon itself to provide a multiplicity of ruffles bunched together so as to define the body. More particularly, the abrasive material forming the body can include an outer sheet of substantially fine mesh exposed at an exterior thereof for making contact with the skin of an individual's body or with an object or surface in the kitchen or bathroom of a home and an inner sheet of substantially coarse mesh substantially covered by the outer sheet and disposed at an interior thereof for providing overall rigidity to the body.

Furthermore, the elongated strap generally is in the form of a continuous loop and is comprised of interwoven strands of flexible material and further has a substantially flat and narrow configuration. The strap can be of any desired length but preferably is of a length which forms a loop large enough to receive therethrough a variety of hand sizes.

Also, the securing means generally is an elongated string inserted at least one time through the loop of the strap and wound about a circumferential portion of the body and drawn inwardly toward the center of the body to form a winding of the string having a substantially smaller circumference than that of the body which secures the inner end of the loop of the strap to the body at the interior of the body such that the inner end of the strap is substantially hidden from the exterior of the body and the strap extends from the body to the outer end spaced from the body to provide the looped handle for the user to insert one hand through and thereby place the body in the palm of the one hand of the user for holding by the fingers and thumb of the user. The string may also be inserted multiple times through the loop of the strap to form the string into several strands wound multiple times about the circumferential portion of the body and drawn inwardly toward the center of the body to form a multi-strand winding of the string.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
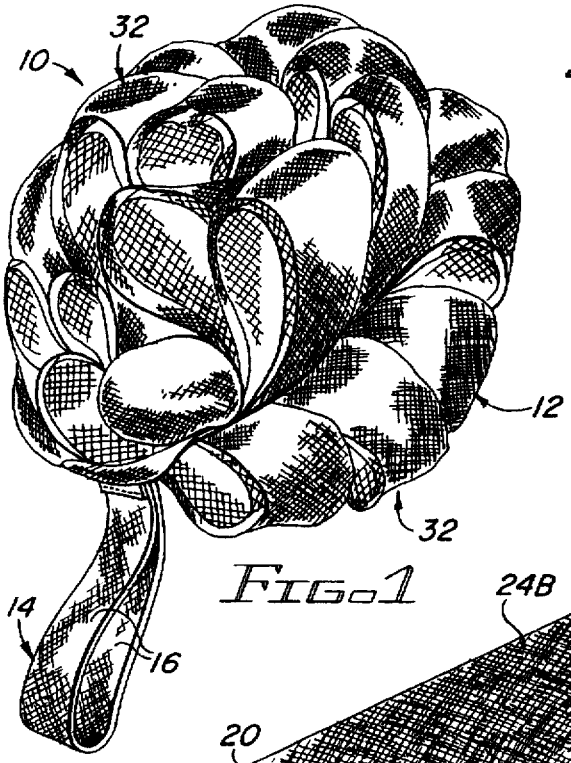
FIG. 1 is a perspective view of the cleansing device of the present invention having a flexible hand strap.
Figure 4:
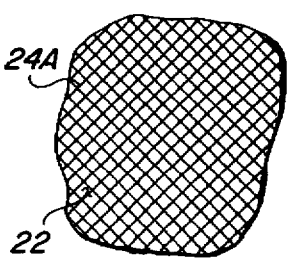
FIG. 4 is an enlarged detailed plan view of a portion of the inner coarse mesh sheet of FIG. 2A.
Figure 5:
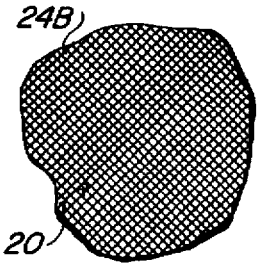
FIG. 5 is an enlarged detailed plan view of a portion of the outer fine mesh sheet of FIG. 2A.
Figure 3A:
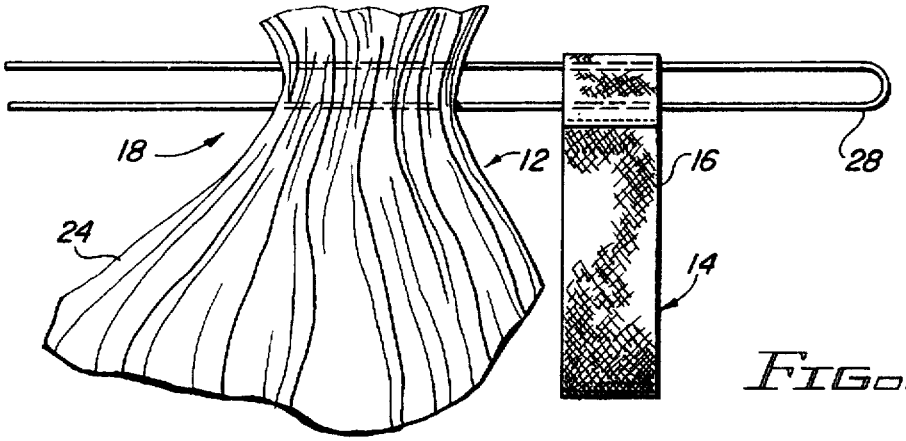
FIG. 3A is a perspective view of the body in fragmentary form and of a string and elongated strap in the process of securing the elongated strap to the body of the cleansing device.
Figure 3B:
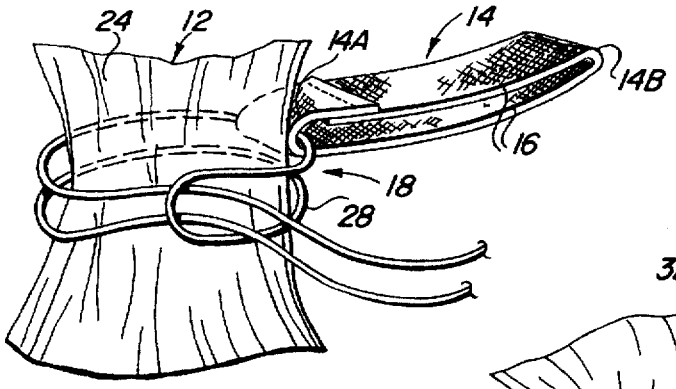
FIG. 3B is another perspective view of the body, string and elongated strap further along in relation to FIG. 3A in the process of securing the elongated strap to the body of the cleansing device.
Figure 3C:
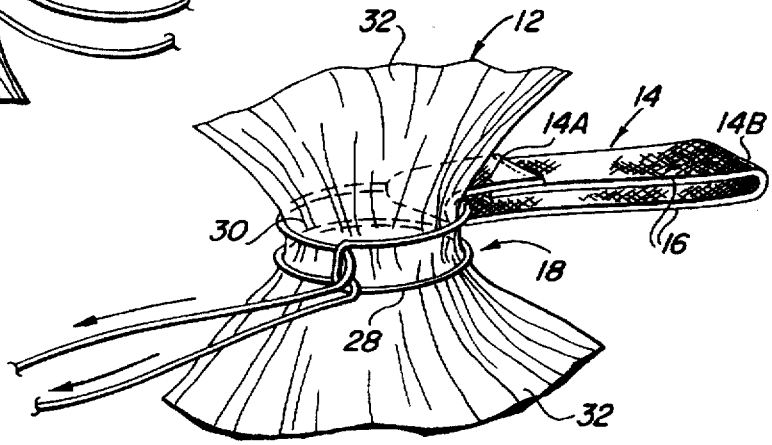
FIG. 3C is still another perspective view of the body, string and elongated strap still further along in relation to FIG. 3B in the process of securing the elongated strap to the body of the cleaning device.
Figure 3D:
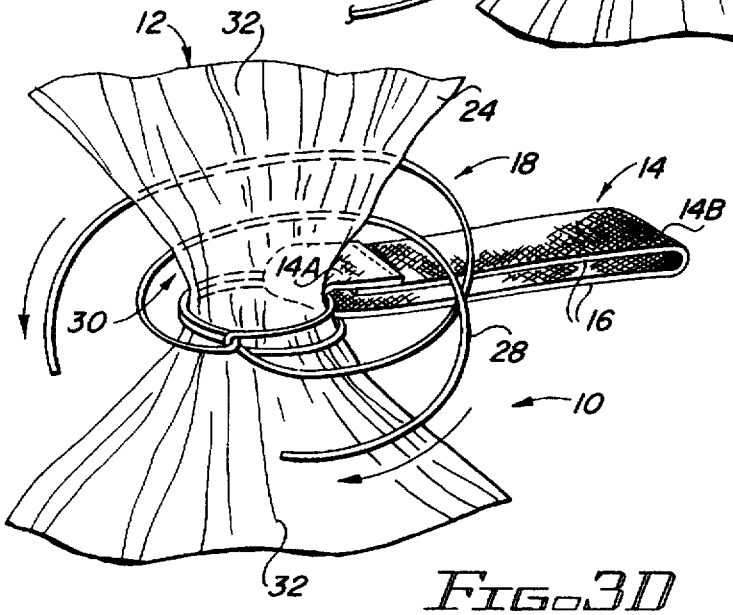
FIG. 3D is yet another perspective view of the body, string and elongated strap yet further along in relation to FIG. 3C in the process of securing the elongated strap to the body of the cleansing device.

Referring to the drawings and particularly to FIG. 1, there is illustrated a cleansing device, generally designated 10, of the present invention. Basically, the cleansing device 10 includes a body 12 of flexible abrasive material, an elongated flexible strap 14 provided in the form of a loop 16, and securing means 18 (see FIG. 3D) for securing an inner end 14A of the strap 14 to a central portion of the body 12 such that the strap 14 extends from the body 12 to an outer end 14B thereof spaced from the body 12 to provide a looped handle.16 for a user to insert one hand through and thereby place the body 12 in the palm of the one hand of the user for holding by the fingers and thumb of the user.

Referring now to FIGS. 1 to 5, the body 12 generally has a substantially fine mesh 20 of abrasive material, as shown particularly in FIGS. 2A–2D and 5, exposed at the exterior of the body 12 for making contact with the skin of an individual's body or with an object or surface in the kitchen or bathroom of a home and a substantially coarse mesh 22 of abrasive material, as shown particularly in FIGS. 2A–2D and 4, disposed at the interior of the body 12 for providing overall bulk and support to the body 12. Alternatively, the body 12 may have the substantially fine mesh 20 interspersed with the substantially coarse mesh 22 throughout the body 12.

Figure 2A:
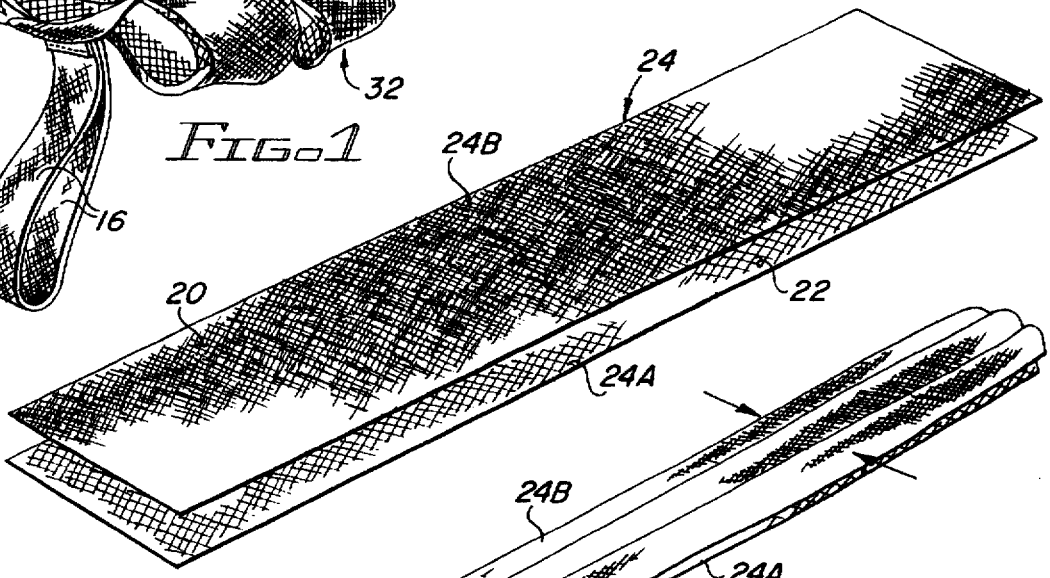
FIG. 2A is a perspective view of an unfolded pair of inner and outer respectively coarse and fine mesh sheets of an inelastic flexible netting-like abrasive material provided to form a body of the cleansing device.
Figure 2B:
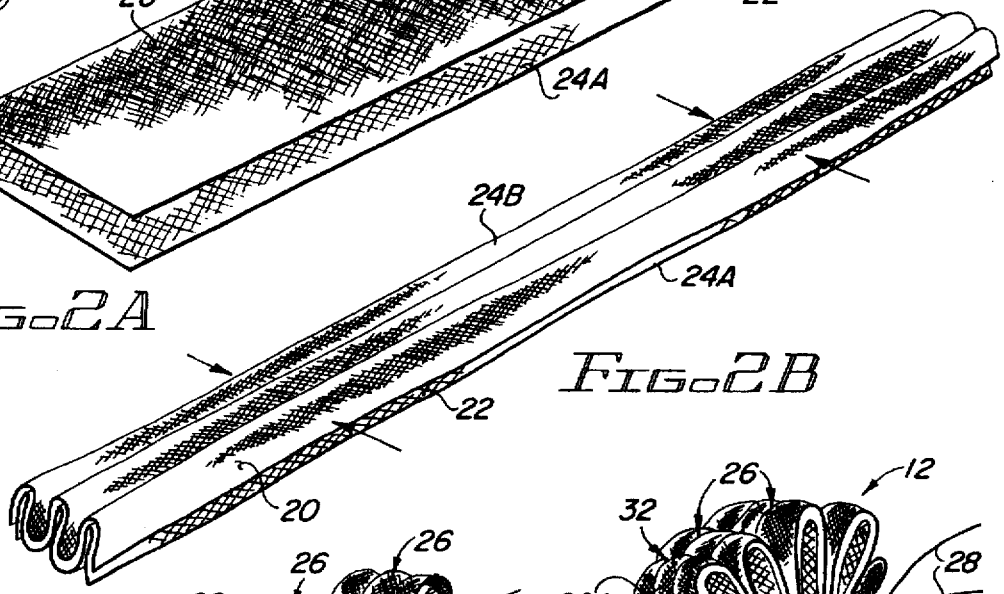
FIG. 2B is another perspective view of the coarse and fine mesh sheets being folded onto themselves in a transverse direction in the process of forming the body of the cleansing device.
Figure 2C:
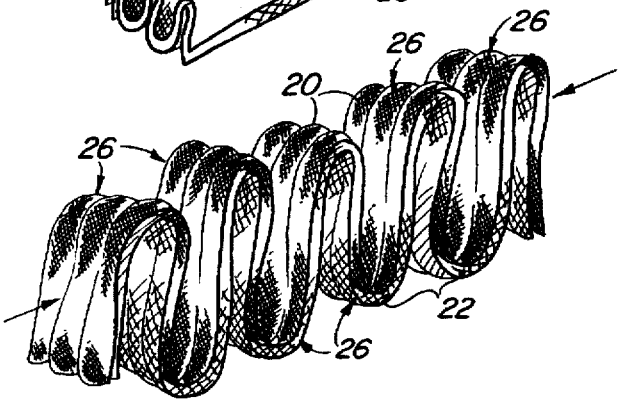
FIG. 2C is still another perspective view of the coarse and fine mesh sheets being folded yet again onto themselves in a longitudinal direction forming a multiplicity of ruffles bunched together in the process of forming the body of the cleansing device.
Figure 2D:
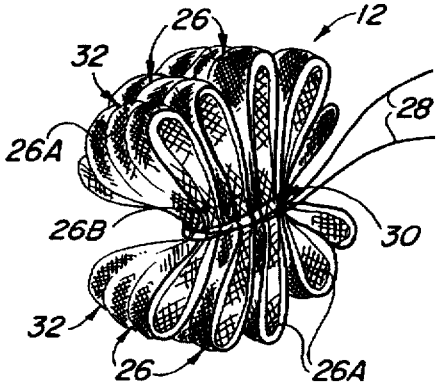
FIG. 2D is yet another perspective view of the coarse and fine mesh sheets being drawn inwardly toward a center of the multiplicity of ruffles by an elongated string wound thereabout in the process of forming the body of the cleansing device.

The body 12 is generally formed by at least one sheet 24 of a suitable inelastic flexible netting-like material, such as nylon, folded upon itself to provide a multiplicity of ruffles 26 bunched together so as to define the body 12. The body 12 may also be formed by a pair of inner and outer sheets 24A, 24B of the inelastic flexible netting-like material folded upon themselves to provide the multiplicity of ruffles 26 with the inner sheet 24A being preferably the substantially coarse mesh 22 disposed at the interior of the body 12 and the outer sheet 24B being the substantially fine mesh 20 exposed at the exterior of the body 12 and substantially covering the inner sheet 24A, as shown particularly in FIGS. 2A–2D. The ruffles 26 generally have loop ends 26A disposed at the exterior of the body 12 which make contact with the skin of the individual's body or with the object or surface found in the kitchen or bathroom of the home, and interior portions 26B which extend between the loop ends 26A. FIG. 2A shows the pair of inner and outer sheets 24A, 24B in an unfolded condition, with the sheets disposed adjacent to one another with one above the other. FIG. 2B shows the pair of inner and outer sheets 24A, 24B folded onto itself in a first, transverse or widthwise, direction. FIG. 2C shows the pair of inner and outer sheets 24A, 24B folded yet again onto itself in a second, longitudinal or lengthwise, direction, extending generally transverse to the first direction, thereby forming the muliplicity of ruffles 26 in a bunched together folded condition. FIG. 2D shows the pair of inner and outer sheets 24A, 24B drawn inwardly toward a center of the muliplicity of ruffles 26 by the securing means 16 being wound thereabout and the elongated strap 14 secured thereto, as is described below with reference to FIGS. 3A–3D.

The strap 14 generally in the form of the loop 16 is preferably comprised of interwoven strands of flexible material and further has a substantially flat and narrow configuration. The strap 14 may have other constructions and configurations within the purview of the present invention. The ends of the strap 14 are generally stitched together to provide a continuous or endless loop but can be attached to one another by any other suitable means so as to form the desired loop 16. The inner end 14A of the strap 14 which is secured to the interior of the body 12 is substantially hidden therewithin. The outer end 14B of the strap 14 is substantially exposed beyond the exterior of the body 12. The strap 14 can be of any desired length but is preferably of a length generally which forms a loop 16 large enough to receive therethrough a variety of hand sizes. The material forming the strap 14 can be either substantially inelastic or elastic in nature.

The securing means 18 generally is an elongated cord or string 28 preferably made of relatively inelastic material. The string can be made from any suitable material, such as cotton or a separate strip of the netting itself. The elongated string 28 is inserted at least one time through the loop 16 of the strap 14 and wound about a circumferential portion of the body 12, preferably centrally located, and drawn inwardly toward the center of the body 12 and secured to itself to form a winding of the string 28 having a substantially smaller circumference than that of the body 12 which secures the inner end 14A of the loop 16 of the strap 14 to the body 12 at the interior of the body 12 such that the secured inner end 14A of the strap 14 is substantially hidden from the exterior of the body 12. The strap 14 extends from the body 12 to the outer end 14B spaced from the body 12 to provide the looped handle 16 for the user to insert one hand through and thereby place the body 12 in the palm of the one hand of the user for holding by the fingers and thumb of the user. The string 28 may also be inserted multiple times through the loop 16 of the strap 14 to form the string 28 into several strands wound multiple times about the circumferential portion of the body 12 and drawn inwardly toward the center of the body 12 to form a multi-strand winding of the string 28 having the same substantially smaller circumference than that of the body 12 as in the case of there being only one strand of the string 28 wound about the body 12.

Winding of the string 28 about the body 12 generally has the effect of bunching together the interior portions 26B of the ruffles 26 toward the center of the body 12. This bunching effect generally forms a central portion 30 from which outwardly projects a pair of lobes 32 formed of the loop ends 26A of the ruffles 26 extending radially in every direction. Each loop end 26A also has generally the same length and so the lobes 32 of the body 12 formed thereby generally have a spherical shape. Since the netting-like material which makes up the body 12 is generally pliable, the spherical shape of the body 12 is deformable during use of the cleansing device 10 such as by application of pressure and contacting the object or surface to be cleaned in a scouring or scrubbing motion. The ball-like shape of the body 12 will generally return after use without becoming attenuated.

To summarize, the cleansing device 10 is formed by steps which include forming the body 12 by providing at least one and preferably a pair of sheets 24 of inelastic flexible netting-like abrasive material in layered relationship in which one sheet overlies the other sheet and folding the sheets 24 transversely and longitudinally upon themselves to provide the multiplicity of ruffles 26 bunched together so as to define the body 12. The steps further include providing the elongated flat and narrow strap 14 comprised of the interwoven strands of flexible material and in the form of the loop 16, and providing the elongated string 28. The string 28 is then inserted at least one time through the loop 16 of the strap 14 and wound about a central circumferential portion of the body 12. The string 28 is next drawn inwardly toward the center of the body 12 and secured to itself so as to thereby form a string winding having a substantially smaller circumference than that of the body 12 which secures the inner end 14A of the loop 16 of the strap 14 to the body 12 at the interior of the body 12. In such manner, 14A inner end 14A of the strap 14 is substantially hidden from the exterior of the body 12 and the strap 14 extends from the body 12 to the outer end 14B spaced from the body 12 to provide the looped handle 16 for the user to insert one hand through and thereby place the body 12 in the palm of the one hand of the user for holding by the fingers and thumb of the user.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

I claim:

1. A cleansing device, comprising:

(a) a body of flexible abrasive material;

(b) an elongated flexible strap provided in the form of a loop; and (c) means for securing an inner end of said strap to substantially a central portion of said body such that said strap extends from said body to an outer end thereof spaced from said body to provide a looped handle for a user to insert one hand through and thereby place said body in the palm of the one hand of the user for holding by the fingers and thumb of the user;

(d) said securing means being an elongated string inserted at least one time through said loop of said strap and wound about a circumferential portion of said body and drawn inwardly toward a center of said body to form a winding of said string having a substantially smaller circumference than that of said body which secures an inner end of said loop of said strap to said body at an interior of said body such that said inner end of said loop of said strap is substantially hidden from an exterior of said body and said loop of said strap extends from said body to an outer end spaced from said body to provide said looped handle for the user to insert one hand through and thereby place said body in the palm of the one hand of the user for holding by the fingers and thumb of the user.

2. The device of claim 1 wherein said body has a substantially fine mesh of abrasive material exposed at an exterior of said body.

3. The device of claim 1 wherein said body has a substantially coarse mesh of abrasive material disposed substantially at an interior of said body.

4. The device of claim 1 wherein said body has a substantially coarse mesh of abrasive material and a substantially fine mesh of abrasive material which is interspersed with said coarse mesh of abrasive material throughout said body.

5. The device of claim 1 wherein said body is formed by at least one sheet of inelastic flexible netting-like material folded upon itself to provide a multiplicity of ruffles bunched together so as to define said body.

6. The device of claim 1 wherein said body is formed by a pair of inner and outer sheets of inelastic flexible netting-like material folded upon themselves to provide a multiplicity of ruffles bunched together so as to define said body, said inner sheet being a substantially coarse mesh disposed substantially at an interior of said body and said outer sheet being a substantially fine mesh exposed at an exterior of said body and substantially covering said inner sheet.

7. The device of claim 1 wherein said strap is comprised of interwoven strands of flexible material.

8. The device of claim 1 wherein said strap has a substantially flat and narrow configuration.

9. A cleansing device, comprising:

(a) a body of flexible abrasive material;

(b) an elongated flexible strap provided in the form of a loop; and (c) means for securing an inner end of said strap to substantially a central portion of said body such that said strap extends from said body to an outer end thereof spaced from said body to provide a looped handle for a user to insert one hand through and thereby place said body in the palm of the one hand of the user for holding by the fingers and thumb of the user;

(d) said securing means being an elongated string inserted multiple times through said loop of said strap to form said string into several strands wound multiple times about a circumferential portion of said body and drawn inwardly toward the center of said body to form a multi-strand winding of said string having a substantially smaller circumference than that of said body which secures an inner end of said loop of said strap to said body at an interior of said body such that said inner end of said strap is substantially hidden from an exterior of said body and said strap extends from said body to an outer end thereof spaced from said body to provide said looped handle for the user to insert one hand through and thereby place said body in the palm of the one hand of the user for holding by the fingers and thumb of the user.

10. A cleansing device, comprising:

(a) a body formed by at least one sheet of inelastic flexible netting-like material folded upon itself to provide a multiplicity of ruffles bunched together so as to define said body;

(b) an elongated strap comprised of interwoven strands of flexible material and provided in the form of a loop; and (c) means for securing an inner end of said strap to said body such that said strap extends from said body to an outer end thereof spaced from said body to provide a looped handle for a user to insert one hand through and thereby place said body in the palm of the one hand of the user for holding by the fingers and thumb of the user;

(d) said securing means being an elongated string inserted at least one time through said loop of said strap and wound about a circumferential portion of said body and drawn inwardly toward the center of said body to form a winding of said string having a substantially smaller circumference than that of said body which secures an inner end of said loop of said strap to said body at an interior of said body such that said inner end of said strap is substantially hidden from an exterior of said body and said strap extends from said body to an outer end spaced from said body to provide said looped handle for the user to insert one hand through and thereby place said body in the palm of the one hand of the user for holding by the fingers and thumb of the user.

11. The device of claim 10 wherein said at least one sheet of inelastic flexible netting-like material forming said body is a substantially fine mesh of abrasive material exposed at an exterior of said body.

12. The device of claim 10 wherein said at least one sheet of inelastic flexible netting-like material forming said body is a substantially coarse mesh of abrasive material disposed substantially at an interior of said body.

13. The device of claim 10 wherein said at least one sheet of inelastic flexible netting-like material forming said body is a substantially coarse mesh of abrasive material and a substantially fine mesh of abrasive material which is interspersed with said coarse mesh of abrasive material throughout said body.

14. The device of claim 10 wherein said at least one sheet of inelastic flexible netting-like material forming said body is a pair of inner and outer said sheets, said inner sheet being a substantially coarse mesh disposed substantially at an interior of said body and said outer sheet being a substantially fine mesh exposed at an exterior of said body and substantially covering said inner sheet.

15. The device of claim 10 wherein said strap has a substantially flat and narrow configuration.

16. A cleansing device comprising:

(a) a body formed by at least one sheet of inelastic flexible netting-like material folded upon itself to provide a multiplicity of ruffles bunched together so as to define said body;

(b) an elongated strap comprised of interwoven strands of flexible material and provided in the form of a loop; and (c) means for securing an inner end of said strap to said body such that said strap extends from said body to an outer end thereof spaced from said body to provide a looped handle for a user to insert one hand through and thereby place said body in the palm of the one hand of the user for holding by the fingers and thumb of the user;

(d) said securing means being an elongated string inserted multiple times through said loop of said strap to form said string into several strands wound multiple times about a circumferential portion of said body and drawn inwardly toward the center of said body to form a multi-strand winding of said string having a substantially smaller circumference than that of said body which secures an inner end of said loop of said strap to said body at an interior of said body such that said inner end of said strap is substantially hidden from an exterior of said body and said strap extends from said body to an outer end thereof spaced from said body to provide said looped handle for the user to insert one hand through and thereby place said body in the palm of the one hand of the user for holding by the fingers and thumb of the user.

17. A cleansing device, comprising:

(a) a body formed by at least one sheet of inelastic flexible netting-like material folded upon itself to provide a multiplicity of ruffles bunched together so as to define said body;

(b) an elongated flat and narrow strap comprised of interwoven strands of flexible material and provided in the form of a loop; and (c) an elongated string inserted at least one time through said loop of said strap and wound about a circumferential portion of said body and drawn inwardly toward the center of said body to form a winding of said string having a substantially smaller circumference than that of said body which secures an inner end of said loop of said strap to said body at an interior of said body such that said inner end of said strap is substantially hidden from an exterior of said body and said strap extends from said body to an outer end spaced from said body to provide a looped handle for a user to insert one hand through and thereby place said body in the palm of the one hand of the user for holding by the fingers and thumb of the user.

18. The device of claim 17 wherein said at least one sheet of inelastic flexible netting-like material forming said body is a substantially fine mesh of abrasive material exposed at an exterior of said body.

19. The device of claim 17 wherein said at least one sheet of inelastic flexible netting-like material forming said body is a substantially coarse mesh of abrasive material disposed substantially at an interior of said body.

20. The device of claim 17 wherein said at least one sheet of inelastic flexible netting-like material forming said body is a substantially coarse mesh of abrasive material and a substantially fine mesh of abrasive material which is interspersed with said coarse mesh of abrasive material throughout said body.

21. The device of claim 17 wherein said at least one sheet of inelastic flexible netting-like material forming said body is a pair of inner and outer said sheets, said inner sheet being a substantially coarse mesh disposed substantially at an interior of said body and said outer sheet being a substantially fine mesh exposed at an exterior of said body and substantially covering said inner sheet.

22. The device of claim 17 wherein said string is inserted multiple times through said loop of said strap to form said string into several strands wound multiple times about said circumferential portion of said body and drawn inwardly toward said center of said body to form a multi-strand winding of said string.

23. A method for producing a cleansing device having a flexible hand strap, said method comprising the steps of:

(a) forming a body by providing at least one sheet of inelastic flexible netting-like material and folding said at least one sheet upon itself to provide a multiplicity of ruffles bunched together so as to define said body;

(b) providing an elongated flat and narrow strap of flexible material in the form of a loop;

(c) providing an elongated string; and (d) inserting said elongated string at least one time through said loop of said strap and winding said string about a circumferential portion of said body and drawing said string inwardly toward the center of said body and thereby forming a winding of said string having a substantially smaller circumference than that of said body which secures an inner end of said loop of said strap to said body at an interior of said body such that said inner end of said strap is substantially hidden from an exterior of said body and said strap extends from said body to an outer end spaced from said body to provide a looped handle for a user to insert one hand through and thereby place said body in the palm of the one hand of the user for holding by the fingers and thumb of the user.

24. The method of claim 23 wherein said step of forming said body by providing said at least one sheet of inelastic flexible netting-like material includes providing a substantially fine mesh of abrasive material exposed at an exterior of said body.

25. The method of claim 23 wherein said step of forming said body by providing said at least one sheet of inelastic flexible netting-like material includes providing a substantially coarse mesh of abrasive material disposed substantially at an interior of said body.

26. The method of claim 23 wherein said step of forming said body by providing said at least one sheet of inelastic flexible netting-like material includes providing a substantially coarse mesh of abrasive material and a substantially fine mesh of abrasive material which is interspersed with said coarse mesh of abrasive material throughout said body.

27. The method of claim 23 wherein said step of forming said body by providing said at least one sheet of inelastic flexible netting-like material includes providing a pair of inner and outer said sheets, said inner sheet being a substantially coarse mesh disposed substantially at an interior of said body and said outer sheet being a substantially fine mesh exposed at an exterior of said body and substantially covering said inner sheet.

28. The method of claim 23 wherein said step of providing said string includes inserting said string multiple times through said loop of said strap and thereby forming said string into several strands wound multiple times about said circumferential portion of said body and drawing said string inwardly toward said center of said body and thereby forming a multi-strand winding of said string.

29. A cleansing device, comprising:

(a) a body having a multiplicity of ruffles bunched together, said body being defined by at least one sheet of flexible abrasive material folded onto itself in a first direction and folded again upon itself in a second direction extending generally transverse to the first direction to provide said multiplicity of ruffles bunched together and defining said body;

(b) an elongated flexible strap provided in the form of a loop; and (c) means for securing an inner end of said strap to substantially a central portion of said body such that said strap extends from said body to an outer end thereof spaced from said body to provide a looped handle for a user to insert one hand through and thereby place said body in the palm of the one hand of the user for holding by the fingers and thumb of the user.

30. A method for producing a cleansing device having a flexible hand strap, said method comprising the steps of:

(a) forming a body by providing at least one sheet of flexible abrasive material and folding said at least one sheet upon itself to provide a multiplicity of ruffles bunched together so as to define said body, said folding including (i) folding said at least one sheet onto itself in a first direction, and (ii) folding again said at least one sheet onto itself in a second direction extending generally transverse to said first direction to form said muliplicity of ruffles bunched together;

(b) providing an elongated strap of flexible material in the form of a loop; and (c) securing an inner end of said strap to substantially a central portion of said body such that said strap extends from said body to an outer end thereof spaced from said body to provide a looped handle for a user to insert one hand through and thereby place said body in the palm of the one hand of the user for holding by the fingers and thumb of the user.

* * * * *